United States Patent [19]

Pompa

[11] Patent Number: 4,472,838

[45] Date of Patent: Sep. 25, 1984

[54] SHOULDER STRAP PAD

[75] Inventor: Susan Pompa, Lincolnwood, Ill.

[73] Assignee: Robert David Kaplan, Lincolnwood, Ill. ; a part interest

[21] Appl. No.: 479,834

[22] Filed: Mar. 28, 1983

[51] Int. Cl.[3] ..... A41D 13/00; A41D 27/26

[52] U.S. Cl. ..... 2/268; 2/2

[58] Field of Search ..... 2/268, 65, 2

[56] References Cited

U.S. PATENT DOCUMENTS 1,631,694 7/1927 Rick ..... 2/2

3,154,787 11/1964 Newman ..... 2/2

*Primary Examiner*—Doris L. Troutman

*Attorney, Agent, or Firm*—Paul H. Gallagher

[57] ABSTRACT

The pad is made of lambskin or sheepskin, that is, the whole hide including the skin proper and the wool fibers, with a holder strip fitted flat to the skin side and secured thereto. The holder strip is a sheet of fabric with a pair of spaced buttonholes therein. The shoulder strap is threaded through the buttonholes, and when the shoulder strap is applied to the shoulder of the wearer, the pad is disposed with the wool fibers down and engaging the shoulder.

1 Claim, 8 Drawing Figures

SHOULDER STRAP PAD

FIELD OF THE INVENTION

The invention has to do with shoulder straps and particularly the objection heretofore encountered that the shoulder straps often become uncomfortable and sometimes form an indentation or groove in the flesh and actually become painful.

OBJECTS OF THE INVENTION

A broad object of the invention is to provide a means for eliminating the discomfort and pain heretofore occasioned by shoulder straps on the wearer.

Another object is to provide such means utilizing natural sheepskin wherein the wool thereof directly engages the body of the wearer, with all the advantages of natural wool.

An additional object is to provide such means that is effective for distributing the weight imposed by the shoulder strap over a wide area.

Still another object is to provide such means in the form of a pad that is simple and can be applied to the shoulder strap in a simple manner and is securely held thereon.

DESCRIPTION OF A PREFERRED EMBODIMENT

In refering to the overall character of the present invention, it is pointed out that heretofore shoulder straps have on many occasions been uncomfortable and actually painful. This was occasioned by the fact that shoulder straps generally speaking are relatively narrow and without cushioning effect, most of them being made of simple woven cloth and as such, they are non-yielding and produce an actual indentation or groove in the flesh.

Figure 1:
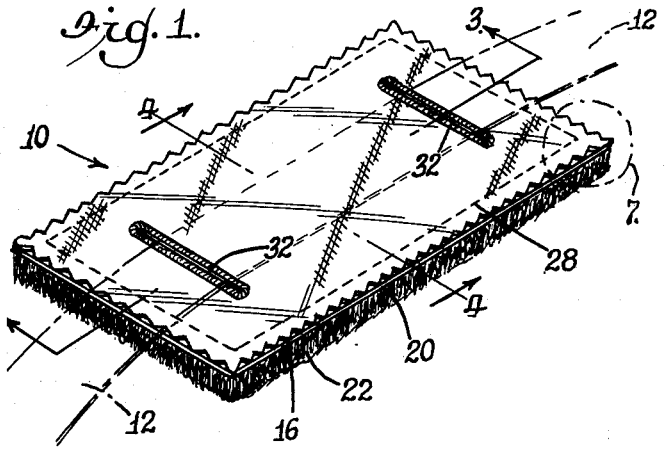
FIG. 1 is a perspective view of the shoulder strap pad made according to the present invention.
Figure 2:
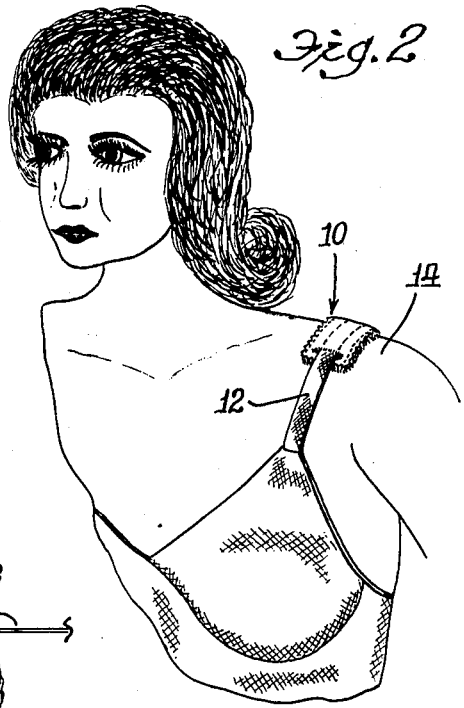
FIG. 2 is a fragmentary perspective view showing the pad applied to the wearer.
Figure 3:
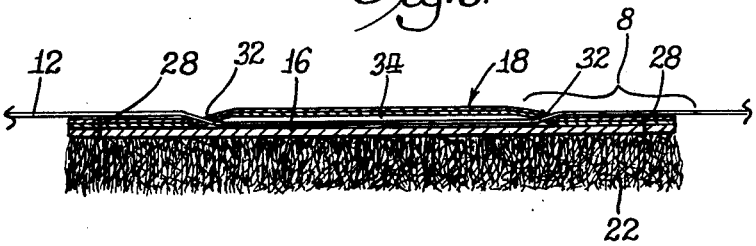
FIG. 3 is a sectional view taken at line 3—3 of FIG. 1.
Figure 4:
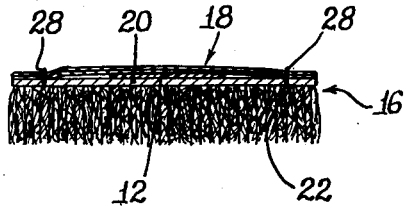
FIG. 4 is a sectional view taken at line 4—4 of FIG. 1.

Referring in detail to the pad of the present invention, the pad in its entirety is indiecated at 10, in FIG. 1, and it is shown applied to the wearer in FIG. 2. In use, the pad 10 is fitted to, and secured to, the shoulder strap indicated at 12 in FIGS. 1 and 2 as will be referred to again hereinbelow. Briefly, the pad 10 provides a soft and very effective cushioning effect on the shoulder 14.

The pad is made up of two main parts, a pad member 16 and a holder strip or backing member 18 secured thereto. The pad member 16 is a piece of sheep's hide, gluteraldeyde tanned, which may be referred to generically as sheepskin or lambskin and includes the skin proper 20 which of course is leather, and the wool fibers 22.

Figure 8:
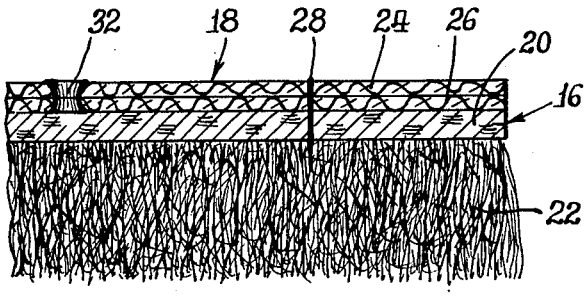
FIG. 8 is a large-scale fragmentary sectional view of the portion of FIG. 3 at the righthand end thereof and indicated at 8.

The holder strip 18 is preferably a simple piece of woven fabric, such as cotton or nylon or other fabric, and in the present case two separate pieces are utilized, fitted face to face and forming in effect a single unitary strip. The construction of this strip is best shown in FIG. 8, which shows the two separate pieces, layers 24, 26, of the same outine shape as the pad member (FIG. 1) and stitched thereto around its periphery as indicated at 28. In practice, in the manufacturing of it, larger pieces are fitted together and sewed, and thereafter cut to form the individual pads, and preferably they are cut by a pinking cut as indicated at 30 to prevent ravelling of the fabric holder strip.

Holes 32 which are preferably buttonholes are formed in the holder strip 18, extending through both layers 24, 26, the stitching thereof being sewed to both layers, as shown best in FIG. 8. These buttonholes extend transversely and are positioned adjacent the ends of the pad. The holder strip, being stitched around its periphery to the pad, has a main central portion, including that between the buttonholes, that is detached and free of the pad member, enabling it to be lifted from or bowed away from the pad member to provide a space 34 therebetween.

The pad is applied to or mounted on the shoulder strap by inserting one end of the shoulder strap through one of the buttonholes and threaded through the space 34 and out through the outer buttonhole. The skin or leather 20 is relatively firm, as compared with the fabric or the holder strip 18, and serves as a firm base against which the end of the shoulder strap engages, and thus guides it through the space to the opposite buttonhole where it is easily manipulated to be drawn out through the second buttonhole. It will be understood that the buttonhole 32 may be positioned relatively close to the ends of the pad member or spaced further therefrom within practicat limits, the consideration being that there be a substantial distance between them. After the pad is thus applied to the shoulder strap, the shoulder strap is then applied to the shoulder as indicated in FIG. 2 with of course the wool fibers directed downwardly and engaging the shoulder.

Figure 5:
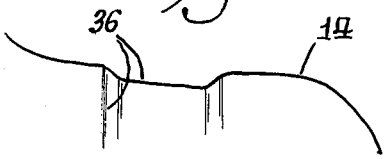
FIG. 5 is a fragmentary view of the wearer's shoulder showing an indentation formed by a shoulder strap as used heretofore.
Figure 7:
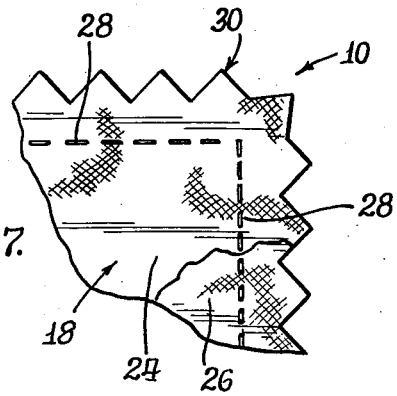
FIG. 7 is a large-scale fragmentary plan view of the portion encircled by the dot-dash line 7 of FIG. 1.
Figure 6:
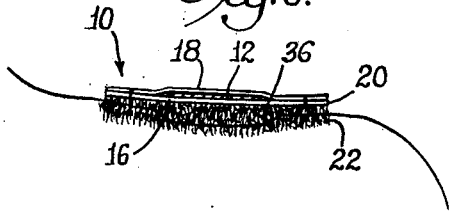
FIG. 6 is a view similar to FIG. 5 but showing the pad of the invention applied over the indentation.

As indicated above, shoulder straps heretofore in general use were relatively firm and non-cushioning, and actually caused a deformation in the shoulder indicated at 36 in FIG. 5. This is in the form of an indentation or groove actually formed in the flesh, produced by the relatively narrow shoulder strap, and is relatively permanent. Discomfort has resulted from relatively great weight applied to the shoulder strap, such as by the weight of the breasts, this oftentimes is particularly true in the case of pregnant women. FIG. 6 shows the pad in place on the shoulder strap and the wool fibers 22 forming an effective cushion on the shoulder. Such shoulder straps as now made according to general popular acceptance have been relatively narrow, the widest ones being about 1" wide, and many narrower than that.

The pad 10 of the invention is of substantial size, relative to such shoulder straps. For example, a shoulder pad 2" wide and 4" long has been found particularly effective. Such a pad well covers the width of the indentation 36, and extends therebeyond outward. Wool of ¾" length fibers has also been found effective, this wool being very pliable and providing cushioning effect in the indentation 36 itself and on the sides therebeyond, this effect being continuous from the depth of the depression onto the sides.

The length of the selected pad referred to above, namely 4", has also been found very effective in that that length is effective for covering nearly all or a substantial portion of the top curved surface of the shoulder that bears the weight of the shoulder strap. The pad can be shifted along the shoulder strap according to the desire and comfort of the individual wearer. This shifting movement is relative, and after a comfortable position of the pad is found, the shoulder strap can be shifted therealong. It will be understood of course that these dimensions are only representative and other dimensions may be utilized as well. Another consideration in selecting measurements, including the length of the wool fibers 22, is the appearance on the person, under the clothes, and general comfort in fitting the clothes.

Certain forms of bras are made with non-detachable shoulder straps, and for accommodating those, the pad 10 may be provided with clips or hooks, of known kind, having openings for insertion of the straps.

The pad, being made of natural sheepskin, provides many advantages of wool: in addition to its warmth in cold weather, it also provides a cooling effect in warm weather, in that perspiration is taken up by the fibers of the wool, and enabled to evaporate therefrom.

Preferably wool that is washable is utilized, such as shearling (lambskin), and it will be understood that the holder strip 18, being of fabric material, is also washable.

I claim:

1. A pad for a shoulder strap comprising, a pad member composed of a piece of gluteraldehyde tanned sheepskin and thereby including a leather element and wool fibers, the leather element constituting a firm back element and the wool fibers constituting a front cushion element, and a holder strip constituted by a piece of cloth fitted flat to the back element and secured thereto around the edges leaving a central portion detached from the back element and loose, the holder strip having spaced buttonholes enabling threading the shoulder strap therethrough, and that threading relationship providing the means for securing the pad on the shoulder strap.

* * * * *